United States Patent [19]

Whitfield

[11] 4,362,037

[45] Dec. 7, 1982

[54] HOLLOW ARTICLE INTERNAL PRESSURE FORMING APPARATUS AND METHOD

[75] Inventor: Therman C. Whitfield, Corona, Calif.

[73] Assignee: Emhart Industries, Inc., Farmington, Conn.

[21] Appl. No.: 200,156

[22] Filed: Oct. 24, 1980

[51] Int. Cl.[3] ..... B26D 26/02

[52] U.S. Cl. ..... 72/58; 72/62; 72/345

[58] Field of Search ..... 72/57-61, 72/345

[56] References Cited

U.S. PATENT DOCUMENTS

| | | | |
|---|---|---|---|
| 788,119 | 4/1905 | Pope . | |
| 795,019 | 7/1905 | Barthelmes . | |
| 1,753,680 | 4/1930 | Batie . | |
| 2,688,297 | 9/1954 | Livermont et al. . | |
| 3,040,684 | 6/1962 | Hillgren . | |
| 3,748,887 | 7/1973 | Widesu | 72/345 |
| 3,919,871 | 11/1975 | Andrasev | 72/57 |
| 4,265,102 | 5/1981 | Shimakata | 72/58 |

*Primary Examiner*—Leon Gilden

*Attorney, Agent, or Firm*—Mahoney & Schick

[57] ABSTRACT

An upper die is movable by a ram downwardly against a lower die with the dies enclosing a hollow article such as a knobshell in die cavities thereof. RAM continued downward movement of the closed dies forces a piston connected to the lower die downwardly against hydraulic fluid of a containing cylinder forcing the hydraulic fluid internally of the knobshell through the neck thereof forming the knobshell outwardly against the die cavity surfaces. The piston size compared to the knobshell size automatically creates a reactive force reversely tending to maintain the dies closed greater than the internal knobshell forming force tending to separate the dies. After knobshell forming, reverse ram movement first relieves piston pressure against the hydraulic fluid and ultimately separates the dies with a knockout member being actuated to eject the formed knobshell. During forming, an automatic pressure relief valve maintains maximum hydraulic fluid pressure not exceeding a predetermined maximum pressure and an automatic fluid refill valve refills the cylinder with hydraulic fluid at separation of the dies for formed knobshell removal.

25 Claims, 6 Drawing Figures

HOLLOW ARTICLE INTERNAL PRESSURE FORMING APPARATUS AND METHOD

BACKGROUND OF THE INVENTION

This invention relates to hollow article internal pressure forming apparatus and method of the type usable for finally outwardly forming or, so called, "bulging" hollow articles such as cup-shaped knobshells and the like. According to the basic concepts of the present invention, the apparatus and methods thereof are arranged such that the forces against fluid internally of the article being so formed tending to outwardly form or bulge the same and therefore also tending to separate the dies containing the article during such bulging are produced directly by forces, the reactive forces of which tend to maintain the dies together. Thus, by automatically maintaining the reactive forces always larger than the article internal fluid forces, there is never a tendency of the dies to separate during the bulging operation, thereby eliminating one of the major difficulties with the prior constructions and methods.

Many prior constructions and methods have heretofore been provided for the internal pressure forming of hollow articles such as cup-shaped articles and one of the major important uses thereof has been the manufacture of hollow knobshells, usually formed of brass or bonze, which are ultimately assembled into doorknobs as provided by the builders hardware industry. In the formation of knobshells, starting by blanking from flat sheet stock, a relatively extensive series of drawing and forming operations are used to ultimately produce both relatively complex configured and relatively simply configured knobshells which may be finally assembled into doorknobs. Furthermore, in almost all such methods, the final major forming operation is that known as a "bulging" operation.

Specifically, after the relatively extensive drawing and forming operations, the hollow knobshells are slightly out of round and otherwise not of the final desired precise configurations, frequently depending on the complexity thereof. For these reasons, directly preceeding the bulging opertion, the knobshells are deliberately formed very slightly undersize. In the bulging operation, internal fluid pressure is applied to the knobshells, usually by hydraulic fluid under pressure, and the knobshells are finally expanded outwardly against containing die surfaces so as to produce the knobshell final exact form.

In this bulging operation, it is obvious that split or separable dies must be used in order that the knobshells may be inserted into and contained by the dies during bulging, and ultimately removed therefrom. As a result, one of the major problems with the prior knobshell bulging apparatuses and methods has been just exactly how to properly maintain the containing dies together during the internal hydraulic fluid pressure application sufficient to complete the bulging operation. If even the slightest separation movement is permitted between the containing dies during such bulging, not only improper forming can result, but scratches and marks on the knobshell outer surfaces can result requiring later extensive surface polishing operations.

The prior successful knobshell bulging methods have, therefore, required the use of complex double-acting presses having opposed rams, one ram applying mechanical or hydraulic forces to maintain the split dies together and the other ram frequently actuating an hydraulic plunger for applying the internal hydraulic fluid bulging forces. Obviously such manufacturing press equipment is relatively expensive and the bulging operations comparatively costly.

OBJECTS AND SUMMARY OF THE INVENTION

It is, therefore, an object of this invention to provide a hollow article internal pressure forming apparatus and method wherein forces are applied to article containing dies to maintain the dies together during an internal pressure forming operation on the article and such die maintaining forces have a direct reaction producing the article internal forming forces thereby directly determining the magnitude thereof. Furthermore, the die maintaining forces are always provided proportionately larger than the forces produced internally of the article. The overall result is that with the article internal forces always directly dependent on the die maintaining forces and of lesser magnitude, it is impossible to apply internal forces on the article for outwardly forming the same and thereby tending to force the dies apart of greater magnitude than the forces being applied to the dies maintaining the same together.

According to a preferred embodiment of the present invention, dies forming an operable pair enclosing the hollow article to be formed in a mutually formed die cavity thereof are moved together and therebeyond progressively into pressure exerting positions. In such pressure exerting positions, means attached to the dies, such as a piston in an enclosing cylinder, forces fluid internally of the article and which serves as the internal forming forces thereon. By arranging the means or piston directly dependent on die closing movement and the reaction to which tends to maintain the dies closed of proportionately larger magnitude than the forces directly applied to the fluid internally of the article being formed and which, in turn, tend to force the dies apart, the die closing forces must inherently always automatically overcome the die separation forces and nothing more is required.

It is a further object of this invention to provide a hollow article internal pressure forming apparatus and method having the foregoing unique qualities of inherent self containment during the article internal pressure forming operation so as to make possible the use of relatively simple press equipment not possible with the prior constructions and methods. With the single direction forces exerted by the press tending to maintain the dies together in closed position necessarily always being of larger magnitude than the resultant forces of the fluid internally of the article being formed and tending to force the dies apart, complex press forces are completely unnecessary. Therefore, a single acting press may be used for accomplishing the methods of the present invention and the more complex and more expensive double acting presses are completely unnecessary so that far less sophisticated equipment may be used while still producing a superior result.

It is still a further object of this invention to provide a hollow article internal pressure forming apparatus and method of the foregoing general character which, despite the superior and highly advantageous results thereof, may be relatively easily controlled for providing the exact intended results. With the unique apparatus making use of fluid for the article internal pressure applying medium, the maximum pressure within the system may be relatively easily controlled in a preferred embodiment form merely by the inclusion of automatic pressure relief means so that excess pressure within the system is never possible. Furthermore, by equally, relatively simple means, it is possible in a preferred embodiment form to always maintain the fluid supply at a proper level ready for the commencement of the next article forming stroke merely by the inclusion of automatic fluid refill means.

Other objects and advantages of the invention will be apparent from the following specification and the accompanying drawings which are for the purpose of illustration only.

DESCRIPTION OF THE BEST EMBODIMENT CONTEMPLATED

Figure 1:
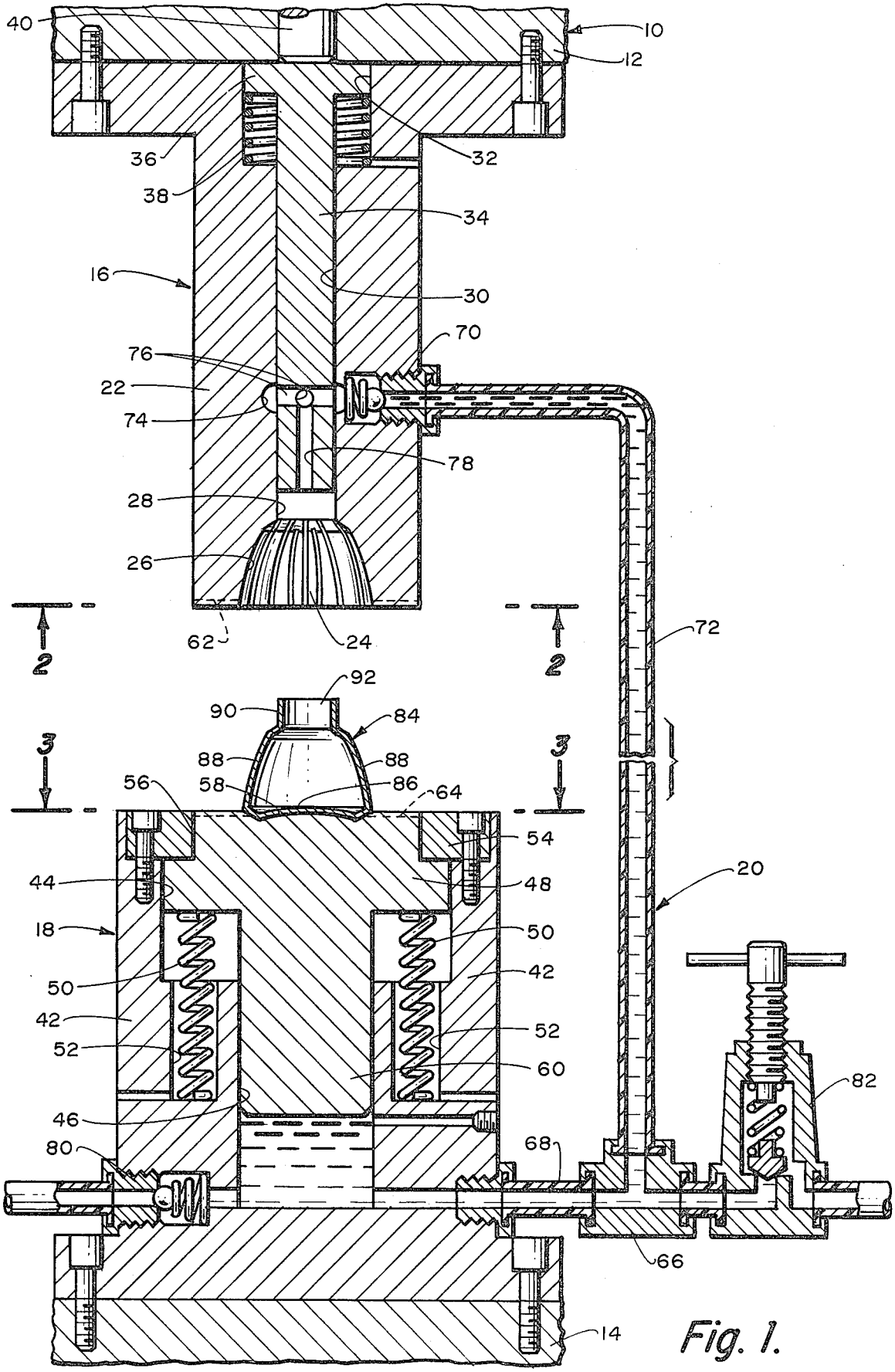
FIG. 1 is a fragmentary, vertical sectional view of a preferred embodiment of the hollow article internal pressure forming apparatus of the present invention, the apparatus as shown in FIG. 1 being in open position with an article to be formed, in this case, a knobshell, properly positioned therein and ready for the commencement of an article forming operation.

Referring to the drawings, a preferred embodiment of the hollow article internal pressure forming apparatus is illustrated herein for use in internal pressure forming or bulging of knobshells which are ultimately assembled into doorknobs as provided by the builders hardware industry. It is pointed out, however, that by such specific use, even though a very prominent and important use, it is not intended thereby to limit the principles of the present invention to the specific apparatus and method illustrated. Furthermore, in the following description, the apparatus described may be formed using usual manufacturing procedures and from usual materials well known to those skilled in the art except as otherwise specifically pointed out.

Figure 2:
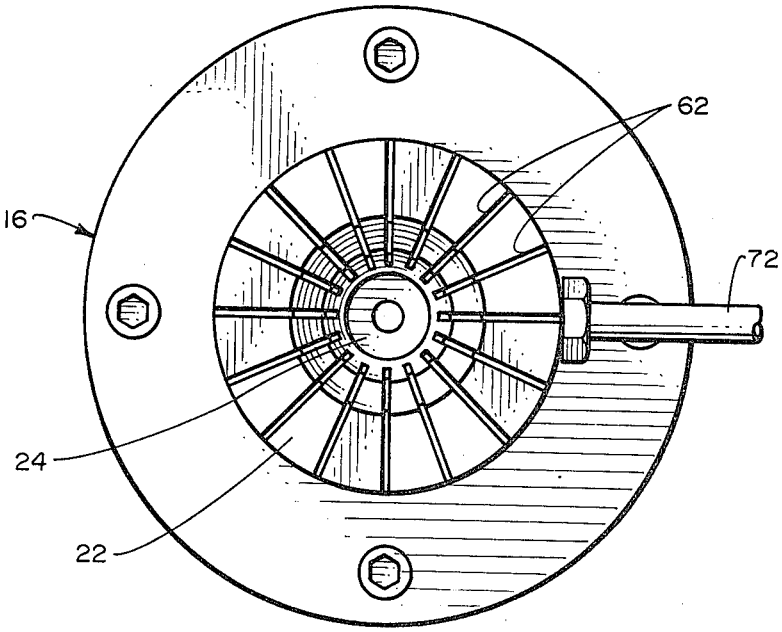
FIG. 2 is an enlarged, fragmentary, horizontal sectional view looking in the direction of the arrows 2—2 in FIG. 1.
Figure 3:
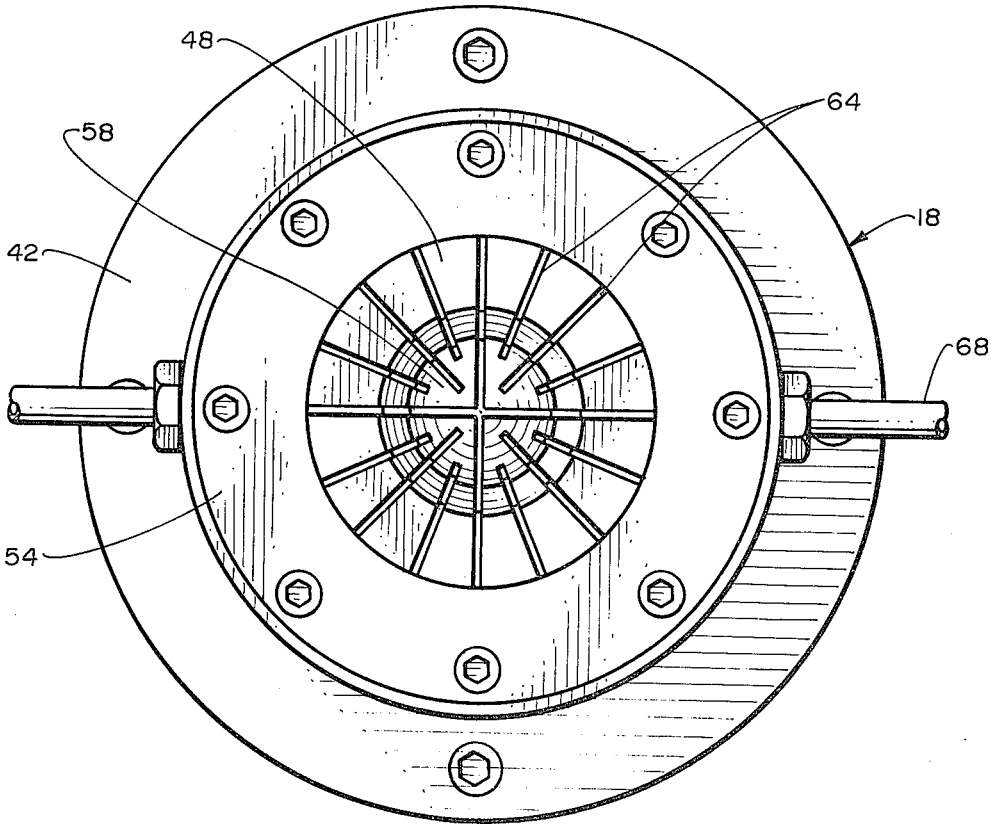
FIG. 3 is an enlarged, fragmentary, horizontal sectional view with the article to be formed removed and looking in the direction of the arrows 3—3 in FIG. 1.

Particularly referring to FIGS. 1 through 3 for the moment, a single-acting press is generally indicated at 10 and includes a vertically reciprocal upper ram 12 either mechanically or hydraulically driven and a lower stationary frame 14, the press being of usual construction to this extent and the ram and frame being partially shown in FIG. 1. An upper die assembly generally indicated at 16 is mounted in the press secured to and reciprocally movable with the upper ram 12, and a lower die assembly generally indicated at 18 is mounted secured to the press lower stationary frame 14 vertically aligned with the upper die assembly. An hydraulic fluid system generally indicated at 20 is operably connected integrated into both of the upper and lower die assemblies 16 and 18 with appropriate controls, all as will be hereinafter explained more in detail.

More specifically, the upper die assembly 16 includes a first or upper die 22 having a central, downwardly opening upper die cavity 24 formed therein by a cavity sidewall portion 26 terminating upwardly internally of the upper die in a cavity neck portion 28. The cavity neck portion 28 is generally cylindrical and is formed by the lower termination of a hollow cylindrical knockout recess 30 extending vertically internally of the upper die 22 and terminating upwardly in an enlarged knockout control portion 32 against the upper ram 12. A cylindrical knockout member 34 is received selectively vertically reciprocal within the knockout recess 30 and terminates upwardly in an enlarged head portion 36 vertically movable in the control portion 32 of the knockout recess 30.

Resilient means, preferably in the form of a coil spring 38 underlies the head portion 36 of the knockout member 34 within the control portion 36 of the knockout recess 30 thereby normally urging the knockout member 34 upwardly against the upper ram 12 so that the die cavity neck portion 28 is normally open free of the knockout member and forming an integral part of the overall upper die cavity 24. A knockout actuator 40 is selectively vertically reciprocal in the ram 12 overlying the head portion 36 of the knockout member 34. In nonactuated position of the knockout member 34, the knockout actuator 40 is fully recessed within the ram 12 as shown in FIG. 1, but selective actuation of the knockout actuator 40 moving the same downwardly, in turn, moves the knockout member downwardly to move into the die cavity neck portion 28 while compressing the coil spring 38.

More specifically to the lower die assembly 18, it includes a lower die block 42 secured downwardly on the press lower stationary frame 14 and having an upwardly opening, cylindrical, lower die recess 44 formed centrally therein. The lower die recess 44 is downwardly integrally joined to a reduced size, cylindrical piston opening 46 which, in turn, terminates downwardly spaced above the press lower stationary frame 14. Thus, to the vertical extent of the piston opening 46, the lower die block 42 assumes the character of a cylinder with the piston opening 46 therein for important purposes of the present invention as will be hereinafter discussed.

A second or lower die 48 is received within the lower die recess 44 vertically reciprocal therein normally resiliently urged upwardly by a multiplicity of preferably coil springs 50 partially received downwardly in appropriate spring pockets 52 of the lower die block 42 as shown in FIG. 1. Upward movement of the lower die 48 by the resilient urging of the springs 50 is limited by a retainer ring 54 secured to the lower die block 42 and partially overlying an annular stepped portion 56 of the lower die. A lower die cavity 58 is formed in the upper surface of the lower die 48 vertically aligned with and opening upwardly toward the upper die cavity 24 of the upper die 22. In this case, the lower die cavity is constructed generally horizontal conforming to the lower surface of the article to be formed, while the previously described upper die cavity 24 is constructed for pressure forming the sidwalls of the article to be formed as will be hereinafter discussed.

Downwardly, the lower die 48 is preferably integrally attached to a cylindrical piston 60 which projects downwardly into and is reciprocal relative to the piston opening 46 of the lower die block 42. When the lower die 48 is in its uppermost position upwardly engaged with the retainer ring 54 as shown in FIG. 1, the lower die 48 is spaced above the lower extremities of the lower die recess 44, and the piston 60 is partially in the lower die recess and partially downwardly in the piston opening 46, the lower end of the piston being spaced above the lower termination of the piston opening. However, the lower die 48 may be urged downwardly within the lower die recess 44 moving the piston 60 on downwardly in the piston opening 46, all for important purposes of the present invention.

It will be noted that the maximum outer diameter of the lower portion of the upper die 22 is at least spaced slightly less than the minimum diameter of the retainer ring 54 on the lower die block 42. With these relative dimensions, the upper die 22 may be brought downwardly against the lower die 48 and with continuing movement, the two dies will move in closed position downwardly within the lower die recess 44 in the lower die block. Furthermore, for purposes to be hereinafter explained, a multiplicity of radial drain slots 62 are formed continuously along the sidewall portion 26 of the upper die cavity 24 and continuing outwardly along the lower surface of the upper die 22 as shown in FIG. 2. Similar drain slots 64 are formed radially outwardly from the lower die cavity 58 along the upper surface of the lower die 48 as shown in FIG. 3.

Referring to FIG. 1, the hydraulic fluid system 20 which communicates between the upper and lower die assemblies 16 and 18 is comprised of the lower portion of the piston opening 46 in the lower die block 42 which is in fluid flow communication with a T-connector 66 through the lower die block and a short, flexible, high pressure hydraulic line 68. The T-connector 66 is, in turn, in fluid flow communication with a check valve 70 in the upper die 22 through a relatively long, flexible, high pressure hydraulic line 72. As can be seen in FIG. 1, the check valve 70 is located spaced above the die cavity 24 of the upper die 22 and is a somewhat usual ball check valve which only permits flow inwardly of the upper die and from the hydraulic line 72.

Directly inwardly of the check valve 70 and fluid flow communicating therewith is an annular distribution recess 74 in the upper die 22 and around the knockout recess 30. A multiplicity of hydraulic fluid openings 76 are formed radially in the knockout member 34 and when the knockout member is in its retracted position as shown in FIG. 1, these hydraulic fluid openings are aligned with the upper die distribution recess 74. The hydraulic fluid openings 76 are all connected downwardly of the knockout member 34 through an hydraulic fluid opening 78 in fluid communication with the upper die cavity 24 in the upper die 22.

The hydraulic fluid system 20 is completed by a main supply check valve 80 and a selectively adjustable escape pressure valve 82, both at the lower die block 42. The main supply check valve 80, which similar to the check valve 70 in the upper die 22, is fluid flow connected at its inlet side to a main hydraulic fluid supply reservior (not shown) and at its outlet side to the lower portion of the piston opening 46 in the lower die block 42. The escape pressure valve 82 is connected in fluid flow communication at its inlet side with the T-connector 66 and at its outlet side also with the hydraulic fluid main supply reservior. The operation and purpose of these two valves will best be described during a description of the operation of the preferred embodiment apparatus.

As previously alluded to, the preferred embodiment of the apparatus and method of the present invention is illustrated herein particularly adapted for the internal pressure forming or bulging of hollow knobshells and a typical knobshell formed ready for such bulging is generally indicated at 84 as shown in FIG. 1. As positioned for the bulging, the knobshell 84 includes a lower, generally horizontal, bottom wall 86 generally conforming to the configuration of the lower die cavity 58 in the lower die 48. The knobshell 84 further includes somewhat vertically extending sidewalls 88 integrally formed with the bottom wall 86 and terminating upwardly in an integrally formed, hollow cylindrical neck portion 90 which opens upwardly to provide an access opening 92 into the knobshell 84.

At this stage of forming, ready for the internal pressure forming or bulging operation, the knobshell 84 has been formed to this point starting with flat sheet metal, usually brass or bronze, and through a multiplicity of various drawing and forming operations is now ready for the operation performed by the apparatus and according to the method of the present invention. As previously stated, the knobshell bottom wall 86 generally conforms to the lower die cavity 58 of the lower die 48, but the knobshell sidewalls 88 are usually slightly out of round from all of the former metal working operations and particularly are of slightly less outward dimensions than the sidewall portion 26 of the upper die cavity 24 in the upper die 22 as will be hereinafter more clearly pointed out. However, the knobshell neck portion 90 is of relatively exact final outward dimensions which are determined to form a slight interference fit with the lower portion of the knockout recess 30 below the knockout member 34 and forming the upper part of the upper die cavity 24 in the upper die 22.

A still further and very important relationship critical to the principles of the present invention determined by the particular article being bulged and, therefore, also the particular upper die cavity, involves the maximum pressure area that can be exerted by the article being formed downwardly against the containing lower die as compared to the maximum pressure area of reaction by the lower die. According to the principles of the present invention, the total force developed by the article being formed downwardly against the lower die is required to be at least slightly less than the total force capable of development by the reaction of the lower die. As applied to the specific embodiment of the apparatus and method of the present invention hereinbefore described, the total horizontal area of the upper die cavity 24 at the lower surface of the upper die 22 must be at least slightly less than the horizontal cross sectional area of the piston 60 within the piston opening 46 in the lower die block 42. The importance of this relationship will be explained more in detail below.

In operation of the preferred embodiment apparatus as hereinbefore described and carrying out a preferred embodiment of the hollow article internal pressure forming method of the present invention, referring to FIG. 1, the upper die assembly 16 is initially spaced above the lower die assembly 18 and the hydraulic fluid system 20 is filled with hydraulic fluid, preferably liquid in the form of hydraulic oil or water or a combination of both. At this time, the knockout member 34 within the first or upper die 22 is in fully retracted position as resiliently urged by the coil spring 38 so that the upper die cavity 24 is fully exposed including the cavity neck portion 28, and the second or lower die 48 with piston 60 is fully upwardly in the lower die block 42 against the retainer ring 54 as resiliently urged by the coil springs 50. The filling of the hydraulic fluid system 20 fills such system from the inlet side of the main supply check valve 80 totally filling the piston opening 46 beneath the piston 60, from the piston opening 46 through the hydraulic line 68, the T-connector 66 and to the inlet side of the escape pressure valve 82, and upwardly from the T-connector 66 through the hydraulic line 72 to the inlet side of the check valve 70 at the upper die 22.

As shown in FIG. 1, one of the knobshells 84 to be internally pressure formed or bulged is positioned on the lower die 48 with the knobshell bottom wall 86 within and conforming to the lower die cavity 58. The upper ram 16 is then actuated moving the upper die 22 downwardly against the lower die 48 with the upper die telescoping the positioned knobshell 84 within the upper die cavity 24 from the position of FIG. 1 to the position of FIG. 4. During such telescoping, the knobshell neck portion 90 is forced fully upwardly into the lower part of the knockout recess 30 provided therefore and due to the slight interference fit, the knobshell neck portion outwardly pressure seals with the upper die 22 within the knockout recess beneath the knockout member 34. Also, it will be noted that the knobshell sidewalls 88 are spaced a small distance inwardly of the sidewall portion 26 of the upper die cavity 24.

Figure 4:
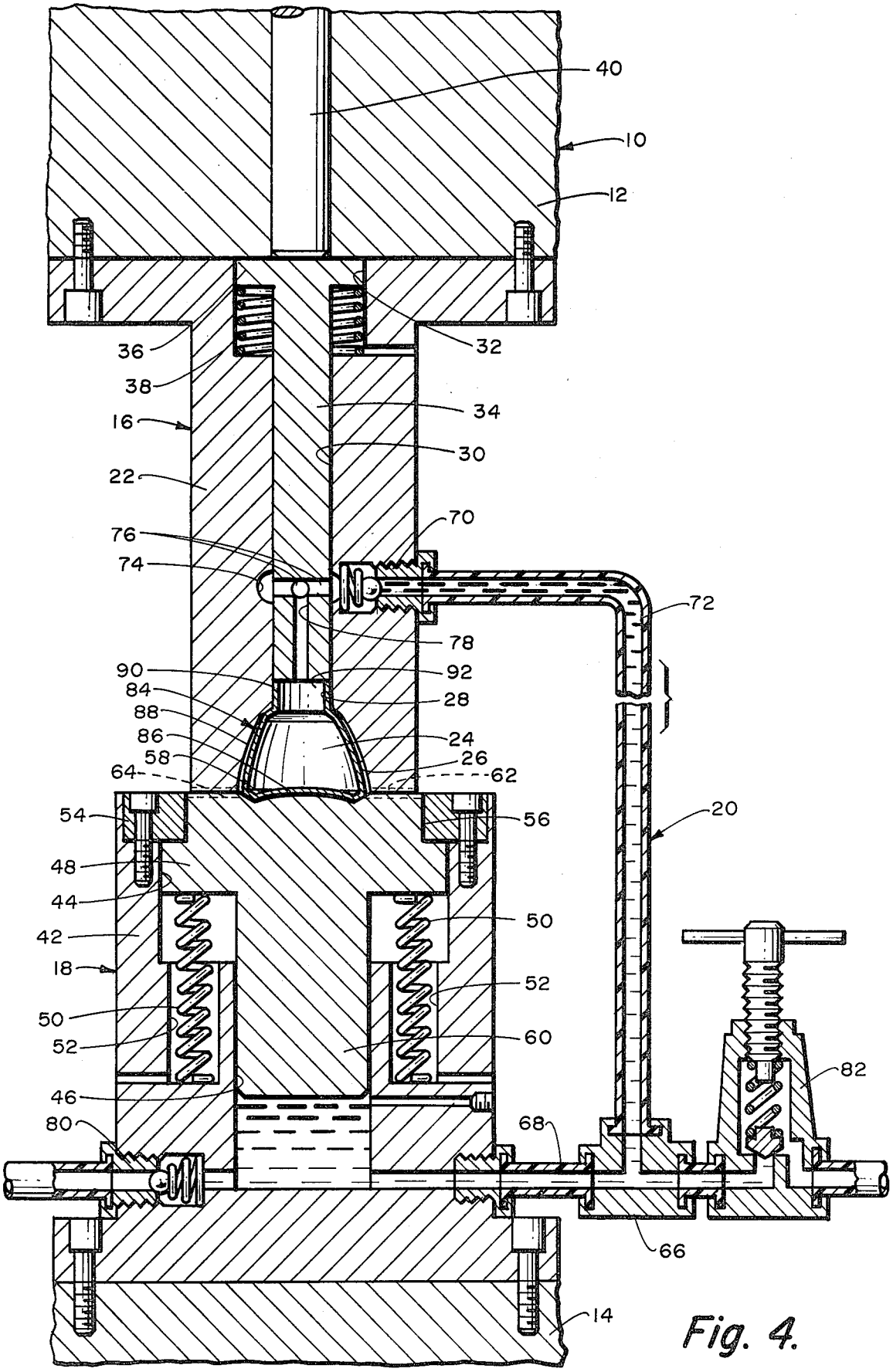
FIG. 4 is a view similar to FIG. 1, but with the apparatus in die closed position and ready for die movement into progressive fluid pressure exerting positions.
Figure 5:
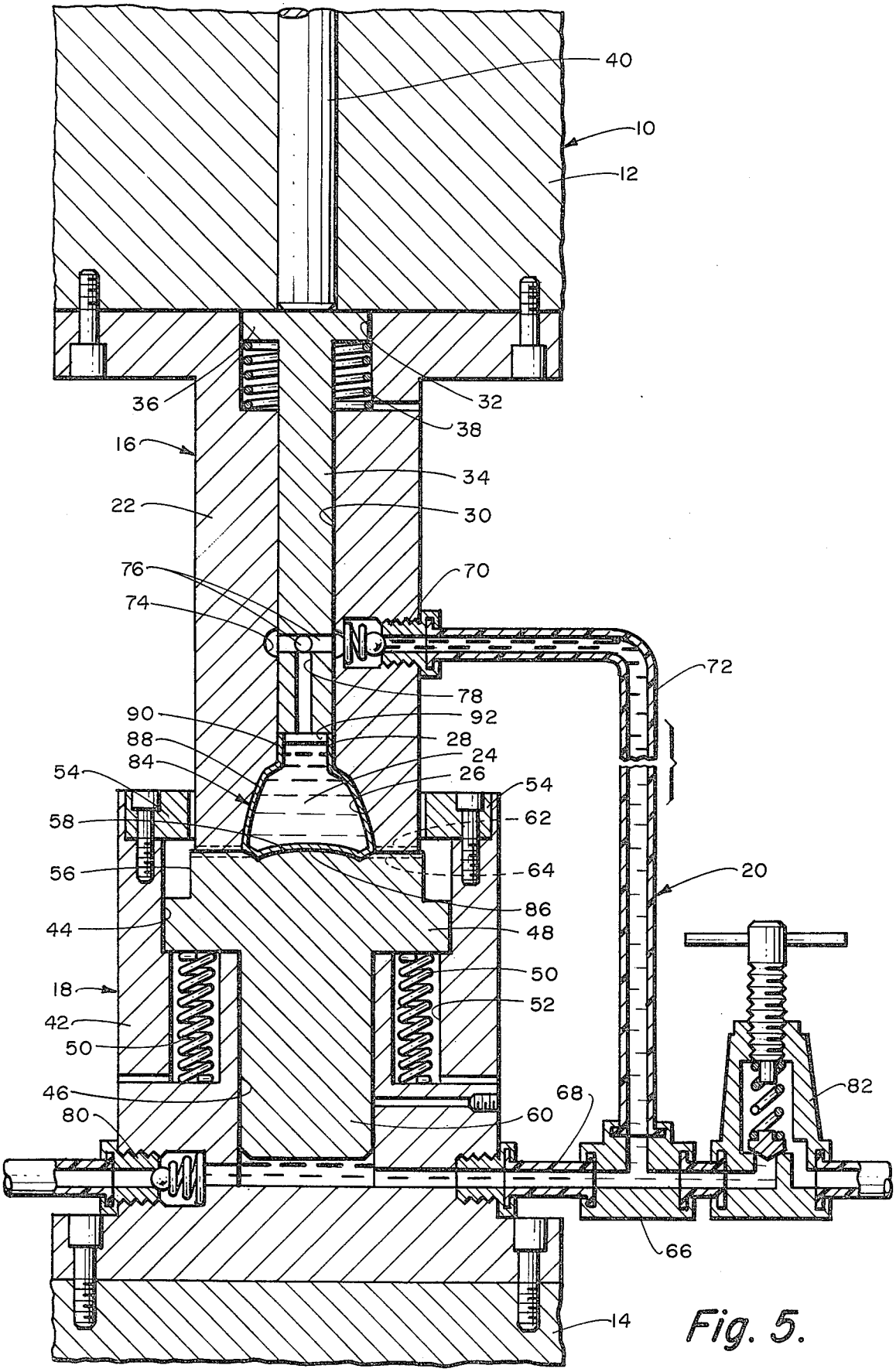
FIG. 5 is a view similar to FIG. 1, but with the dies moved into fluid pressure exerting positions forcing fluid internally of the article to be formed and having completed such forming operation.

Continued downward movement of the upper ram 12 from the position of FIG. 4 and ultimately to the position of FIG. 5 moves the upper die 22 downwardly forcing the lower die 48 downwardly, the two in combination enclosing the knobshell 84 being formed, thereby forcing the piston 60 downwardly which, in turn, forces the hydraulic fluid within the hydraulic fluid system 20 outwardly through the check valve 70 at the upper die 22, through the distribution recess 74, through the hydraulic fluid opening 76 in the knockout member 34 and downwardly through the hydraulic fluid opening 78 into the knobshell neck portion 90 filling the knobshell. Once the continued downward movement of the closed upper and lower dies 22 and 48 by the ram 12 fills the knobshell 84 to be formed, continued downward urging by the ram exerts pressure on the hydraulic fluid within the piston opening 46 by the piston 60 which pressure is transferred through the hydraulic fluid within the hydraulic fluid system 20 to the hydraulic fluid within the knobshell 84 thereby forcing the knobshell sidewalls 88 outwardly against the sidewall portion 26 of the upper die cavity 24 as shown in FIG. 5 so as to carry out the knobshell forming or bulging operation. Since the knobshell neck portion 90 is a pressure fit with the lower part of the knockout recess 30 which forms the upper cavity neck portion 28, the pressure on the hydraulic fluid within the knobshell 84 is fully contained for exerting the necessary pressure.

As shown in FIG. 5, the air originally in the knobshell 84 to be formed, upon the knobshell being filled with hydraulic fluid and pressure being applied thereto during the bulging operation, rises upwardly primarily into the various hydraulic fluid openings in the knockout member 34 and is ultimately compressed sufficiently to exert the necessary pressure for the bulging operation. Furthermore, as the knobshell 84 is bulged outwardly against the upper die 22 within the upper die cavity 24, any air or liquid between the knobshell and the upper and lower dies 22 and 48 within the upper and lower die cavities 24 and 58 is forced outwardly through the drain slots 62 and 64. Still further, as the upper and lower dies 22 and 48 are moved downwardly by the ram 12 moving the piston 60 downwardly against the hydraulic fluid in the pressure exerting manner hereinbefore described, if the pressure of the hydraulic fluid within the hydraulic fluid system 20 reaches and attempts to exceed a predetermined maximum, this excessive pressure is prevented by automatically venting off an appropriate amount of the hydraulic fluid through the escape pressure valve 82, which vented fluid is directed back to the main hydraulic fluid supply reservior (not shown). To conform to the maximum desired system pressure, the escape pressure valve 82 may be adjusted by selective rotation of the actuator thereof, all in a usual manner.

As a final matter for present further discussion and involving the relationship of utmost importance to the principles of the present invention, it has been previously pointed out that the size or horizontal area of the upper die cavity 24 at the lower extremities of the upper die 22 and, therefor, the maximum internal size of horizontal area of the knobshell 84 being bulged, is at least slightly less than the effective size or horizontal area of the piston 60 within the piston opening 46 of the lower die block 42. Thus, as the upper and lower dies 22 and 48 are moved downwardly by the ram 12 forcing hydraulic fluid through the hydraulic fluid system 20 internally of the knobshell 84 being bulged and ultimately developing hydraulic fluid pressure within the knobshell, the reactive pressure on the lower die 48 against the upper die 22 tending to force and maintain the dies together will always be greater than the pressure downwardly against the lower die by the knobshell bottom wall 86 which tends to force the dies apart from the required closed position. This unique relationship of the present invention taking on a specific form in the preferred embodiment apparatus, therefore, eliminates any of the difficulties with the prior constructions in maintaining the dies tightly and properly closed during the internal pressure forming outwardly or bulging of the article to be formed within the die cavity provided by the dies since the greater the pressure exerted by the article being formed tending to separate the dies, the greater the superior reactive pressure tending to maintain the dies closed, the two always necessarily remaining in the same proportionate relationship so as to completely eliminate the difficulties with the prior constructions.

Figure 6:
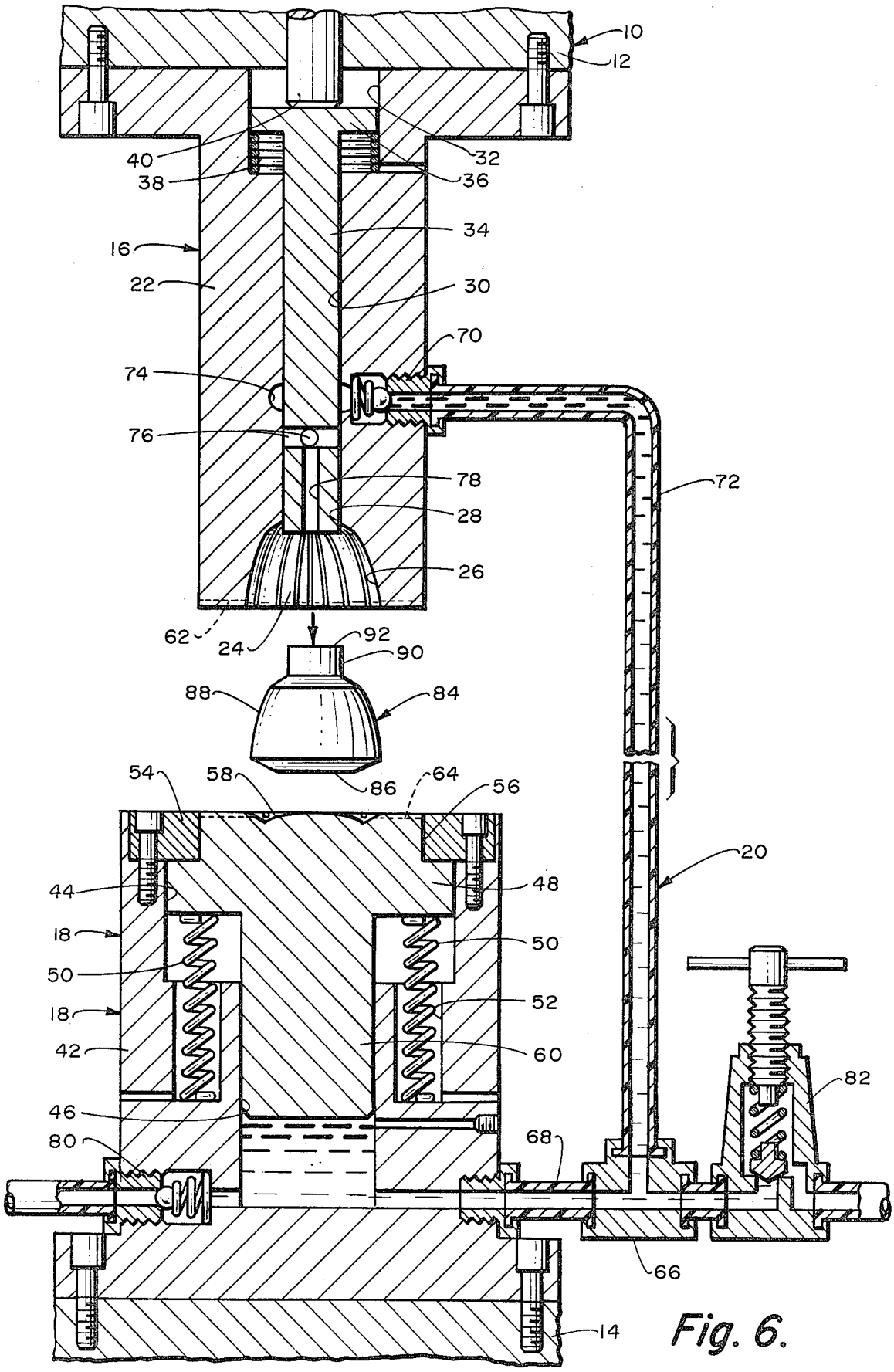
FIG. 6 is a view similar to FIG. 1, but with the dies again in open position at termination of the article forming operation and with a knockout mechanism actuation to eject the article which has been formed.

To complete the operation of the preferred embodiment of the apparatus and carrying out the final method steps of the present invention, from the positions of the upper and lower dies 22 and 48 as shown in FIG. 5 and completing the bulging of the knobshell 84 to its final form, the ram 12 is reversed and the dies vertically separated as shown in FIG. 6. As the upper and lower dies 22 and 48 initially reach the point of separation, the lower die 48 comes into engagement with the retainer ring 54 so that the lower die thereafter remains stationary and continued upward movement of the upper die 22 by the ram 12 vertically separates the dies. Furthermore, since the knobshell neck portion 90 has a pressure fit and the knobshell sidewalls 88 have been bulged outwardly against the upper die 22 as hereinbefore described, the knobshell 84 will remain within the upper die and move upwardly therewith.

The completed or bulged knobshell 84 is then ejected from the upper die 22 by downward movement of the knockout actuater 40 forcing the knockout member 34 downwardly within the knockout recess 30 and, in turn, forcing the knobshell downwardly free of the upper die 22 as shown in FIG. 6. Although when the knockout member 34 is moved downwardly to extended knockout position it displaces the hydraulic fluid openings 76 and 78 downwardly from the distribution recess 74 interrupting the hydraulic fluid system 20 as described, such displacement being shown in FIG. 6, when the knockout actuator 40 is again withdrawn upwardly permitting the coil spring 38 to move the knockout member 34 back upwardly, the full hydraulic fluid system 20 is once again established to the starting position shown in FIG. 1, although further hydraulic fluid will not flow due to the check valve 70. Furthermore, as the upper and lower dies 22 and 48 are withdrawn upwardly by the ram 12 and eventually vertically separate as described, upward movement of the piston 60 within the piston opening 46 will draw in hydraulic fluid from the main supply reservior (not shown) through the main supply check valve 80 properly refilling the hydraulic fluid system 20 ready for the next bulging operation as shown in FIG. 6.

According to the principals of the present invention, therefore, a unique apparatus and method are provided completely eliminating the difficulties of maintaining dies together which are required to enclose an article during the insertion of pressurized fluid internally thereof to outwardly pressure form or bulge such article. According to the present invention, the apparatus is arranged such that the direct reaction to the fluid pressure internally of the article being bulged and which accomplishes the bulging operation is always a greater pressure amount against the dies tending to maintain the dies closed during such bulging operation. Since the reactive force tending to maintain the dies closed is always a proportionately greater amount than the internal pressure within the article tending to separate the dies, the latter can never exceed the former. Not only does this insure more perfectly formed bulged articles which do not require further repairing manfacturing operations, but much more simplified press equipment may be used to carry out the unique bulging method than has heretofore been possible so as to reduce manufacturing costs.

Although the unique inventive principals of the present invention have been illustrated herein used for a specific purpose, namely, the internal pressure forming or bulging of cup-shaped knobshells, such inventive principals are readily applicable to many other uses involving the internal pressure forming of hollow articles. Thus, the inventive principals involved herein should be broadly construed and not limited beyond these specific limitations set forth in the appended claims including the patent equivalents thereof.

I claim:

1. In a forming apparatus for bulging hollow bulbous metal knobshells outwardly relatively small distances against enclosing die cavity surfaces by application of only internal high fluid pressures directed solely through a preformed reduced size knobshell neck access opening; the apparatus including: first and second dies constructed and arranged with said dies movable longitudinally together to a closed position and thereafter in said closed position by continued longitudinal urging placing said dies in progressive longitudinal pressure exerting conditions, said dies in said closed position forming a die cavity having surfaces enclosing said knobshell with a reduced size knobshell neck access opening exposed to said first die, said die cavity surfaces outwardly of said knobshell being exposed at all times venting to the atmosphere; die moving means for moving said dies to and from said closed position and progressively urging said dies into said die longitudinal pressure exerting conditions only while in said closed position; fluid pressure means operably connected free of reaction until said dies are in closed position but directly fluid flow reactive to said dies being urged into said die progressive longitudinal pressure exerting conditions and operably connected to said first die directing fluid flow into said knobshell through said knobshell neck access opening, said fluid pressure means during said dies being urged into said progressive longitudinal pressure exerting conditions at all times exerting a greater reverse longitudinal force on said dies tending to retain said dies in closed position than knobshell forming force created internally outwardly from within said knobshell against said die cavity surfaces tending to urge said dies apart.

2. In a forming apparatus as defined in claim 1 in which said fluid pressure means includes a fluid cylinder operably connected to one of said dies and having a piston longitudinally movable by said one die progressively forcing fluid into said knobshell through said knobshell neck access opening as said one die is placed in said progressive longitudinal pressure exerting conditions.

3. In a forming apparatus as defined in claim 1 in which one of said dies is longitudinally reciprocally mounted in a die block normally resiliently urged to a die closed position and thereafter longitudinally urged into said pressure exerting conditions by the other of said dies to progressively actuate said fluid pressure means.

4. In a forming apparatus as defined in claim 1 in which one of said dies is longitudinally reciprocally mounted in a die block normally resiliently urged to a die closed position and thereafter longitudinally urged into said pressure exerting conditions by the other of said dies to progressively actuate said fluid pressure means; and in which said fluid pressure means includes a fluid cylinder having a longitudinally movable piston operably connected movable with said one die progressively forcing fluid into said knobshell through said knobshell neck access opening during urging of said one die into said progressive longitudinal pressure exerting conditions.

5. In a forming apparatus as defined in claim 1 in which said fluid pressure means includes automatic pressure release means automatically limiting maximum pressure exerted by said fluid pressure means internally of said knobshell during said dies being urged into said progressive longitudinal pressure exerting conditions.

6. In a forming apparatus as defined in claim 1 in which said fluid pressure means includes automatic fluid refill means for automatically refilling said fluid pressure means with fluid to a maximum predetermined amount between said dies being urged into said progressive longitudinal pressure exerting conditions.

7. In a forming apparatus as defined in claim 1 in which one of said dies includes knockout means operably connected thereto reciprocal between a retracted normal position and an extended knockout position for removing said knobshell from said one die during movement into said extended knockout position, said knockout means remaining in said retracted normal position during said movement of said dies into said closed position and urging of said dies into said longitudinal pressure exerting conditions and being movable into said extended knockout position during movement of said one die away from said closed position, said knockout means having a part of said fluid pressure means formed therethrough for establishing fluid flow of said fluid pressure means, into said knobshell neck access opening when said knockout means is in said retracted normal position and interrupting said fluid flow of said fluid pressure means when said knockout means is moved to said extended knockout position.

8. In a forming apparatus as defined in claim 1 in which said first die includes knockout means operably connected reciprocal within said first die between a retracted normal position and an extended knockout position for removing said knobshell from said first die during movement into said extended knockout position, said knockout means remaining in said retracted normal position during said movement of said dies into said closed position and urging of said dies into said longitudinal pressure exerting conditions and being movable into said extended knockout position during movement of said first die away from said closed position, said knockout means having a part of said fluid pressure means formed therethrough within said first die for establishing fluid flow of said fluid pressure means into said knobshell neck access opening when said knockout means is in said retracted normal position and interrupting said fluid flow of said fluid pressure means into said knobshell neck access opening when said knockout means is moved to said extended knockout position.

9. In a forming apparatus as defined in claim 1 in which one of said dies is longitudinally reciprocally mounted in a die block normally resiliently urged to a die closed position and thereafter longitudinally urged into said pressure exerting conditions by the other of said dies to progressively actuate said fluid pressure means; in which said fluid pressure means incudes a fluid cylinder having a longitudinally movable piston operably connected movable with said one die progressively forcing fluid into said knobshell through said knobshell neck access opening during urging of said one die into said progressive longitudinal pressure exerting conditions; and in which said fluid pressure means includes automatic pressure release means automatically limiting maximum pressure exerted by said fluid pressure means internally of said knobshell during said dies being urged into said progressive longitudinal pressure exerting conditions.

10. In a forming apparatus as defined in claim 1 in which said fluid pressure means includes automatic pressure release means automatically limiting maximum pressure exerted by said fluid pressure means internally of said knobshell during said dies being urged into said progressive longitudinal pressure exerting conditions, automatic fluid refill means for automatically refilling said fluid pressure means with fluid to a maximum predetermined amount between said dies being urged into said progressive longitudinal pressure exerting conditions.

11. In a forming apparatus as defined in claim 1 in which one of said dies is longitudinally reciprocally mounted in a die block normally resiliently urged to a stationary position and thereafter longitudinally urged into said pressure exerting conditions by the other of said dies to progressively actuate said fluid pressure means; and in which said fluid pressure means includes a fluid cylinder having a longitudinally movable piston operably connected movable with said one die progressively forcing fluid into said knobshell through said knobshell neck access opening during urging of said one die into said progressive longitudinal pressure exerting conditions, automatic pressure release means automatically limiting maximum pressure exerted by said fluid pressure means internally of said knobshell during said dies being urged into said progressive longitudinal pressure exerting conditions, automatic fluid refill means for automatically refilling said fluid pressure means with fluid to a maximum predetermined amount between said dies being urged into said progressive longitudinal pressure exerting conditions.

12. In a forming apparatus as defined in claim 1 in which one of said dies is longitudinally reciprocally mounted in a die block normally resiliently urged to a die closed position and thereafter longitudinally urged into said pressure exerting conditions by the other of said dies to progressively actuate said fluid pressure means; in which said fluid pressure means includes a fluid cylinder having a longitudinally movable piston operably connected movable with said one die progressively forcing fluid into said knobshell through said knobshell neck access opening during urging of said one die into said progressive longitudinal pressure exerting conditions; and in which one of said dies includes knockout means operably connected thereto reciprocal between a retracted normal position and an extended knockout position for removing said knobshell from said one die during movement into said extended knockout position, said knockout means remaining in said retracted normal position during said movement of said dies into said closed position and urging of said dies into said longitudinal pressure exerting conditions and being movable into said extended knockout position during movement of said one die away from said closed position, said knockout means having a part of said fluid pressure means formed therethrough for establishing fluid flow of said fluid pressure means into said knobshell neck access opening when said knockout means is in said retracted normal position and interrupting said fluid flow of said fluid pressure means when said knockout means is moved to said extended knockout position.

13. In a forming apparatus as defined in claim 1 in which one of said dies is longitudinally reciprocally mounted in a die block normally resiliently urged to a die closed position and thereafter longitudinally urged into said pressure exerting conditions by the other of said dies to progressively actuate said fluid pressure means; in which said fluid pressure means includes a fluid cylinder having a longitudinally movable piston operably connected movable with said one die progressively forcing fluid into said knobshell through said knobshell neck access opening during urging of said one die into said progressive longitudinal pressure exerting conditions, automatic pressure release means automatically limiting maximum pressure exerted by said fluid pressure means internally of said knobshell during said dies being urged into said progressive longitudinal pressure exerting conditions; and in which one of said dies includes knockout means operably connected thereto reciprocal between a retracted normal position and an extended knockout position for removing said knobshell from said one die during movement into said extended knockout position, said knockout means remaining in said retracted normal position during said movemennt of said dies into said closed position, and urging of said dies into said longitudinal pressure exerting conditions and being movable into said extended knockout position during movement of said one die away from said closed position, said knockout means having a part of said fluid pressure means formed therethrough for establishing fluid flow of said fluid pressure means into said knobshell neck access opening when said knockout means is in said retracted normal position and interrupting said fluid flow of said fluid pressure means when said knockout means is moved to said extended knockout position.

14. In a forming apparatus as defined in claim 1 in which one of said dies is longitudinally reciprocally mounted in a die block normally resiliently urged to a die closed position and thereafter longitudinally urged into said pressure exerting conditions by the other of said dies to progressively actuate said fluid pressure means; in which said fluid pressure means includes a fluid cylinder having a longitudinally movable piston operably connected movable with said one die progressively forcing fluid into said knobshell through said knobshell neck access opening during urging of said one die into said progressive longitudinal pressure exerting conditions, automatic pressure release means automatically limiting maximum pressure exerted by said fluid pressure means internally of said knobshell during said dies being urged into said progressive longitudinal pressure exerting conditions; and in which said first die includes knockout means operably connected in said first die reciprocal between a retracted normal position and an extended knockout position for removing said knobshell from said first die during movement into said extended knockout position, said knockout means remaining in said retracted normal position within said first die during said movement of said dies into said closed position and urging of said dies into said longitudinal pressure exerting conditions and being movable into said extended knockout position during movement of said first die away from said closed position, said knockout means having a part of said fluid pressure means to said knobshell neck access opening formed therethrough for establishing fluid flow of said fluid pressure means into said knobshell neck access opening when said knockout means is in said retracted normal position and interrupting said flow of said fluid pressure means into said knobshell neck access opening when said knockout means is moved to said extended knockout position.

15. In a method of bulging hollow bulbous metal knobshells outwardly relatively small distances against enclosing die cavity surfaces by application of only internal high fluid pressures directed solely through a preformed reduced size knobshell neck access opening; the steps of: applying a die moving force longitudinally against a first die to move and maintain said first die and a second die together in closed position enclosing a hollow bulbous metal knobshell within a die cavity surrounded by die cavity surfaces; maintaining said die cavity surfaces outwardly of said knobshell at all times venting to the atmosphere; continuing to urge said first die longitudinally while in said closed position by said die moving force; opposing said die moving force urging in said die closed position which opposition will tend to maintain said dies in said closed position by a reactive force resulting from and causing fluid to be forced to flow by said die moving force continued die urging internally of said knobshell through a preformed reduced size knobshell neck access opening creating a forming force tending to separate said dies while fluid pressure forming said knobshell outwardly against said die cavity surfaces; maintaining at all times said reactive force tending to maintain said dies in said closed position greater than said knobshell internal forming force tending to separate said dies.

16. In a method of bulging hollow bulbous metal knobshells as defined in claim 15 in which said step of opposing said die moving force urging includes urging said dies in said closed position againt a piston in a cylinder containing said fluid to thereby force said fluid to flow internally of said knobshell through said knobshell neck access opening.

17. In a method of bulging hollow bulbous metal knobshells as defined in claim 15 in which said method includes the further step of during said step of opposing said die moving force urging, maintaining maximum pressure of said fluid a maximum amount by automatically relieving said pressure above said maximum.

18. In a method of bulging hollow bulbous metal knobshells as defined in claim 15 in which said method includes the further step of automatically replenishing supply of said fluid to a predetermined amount after said step of opposing said die moving force urging.

19. In a method of bulging hollow bulbous metal knobshells as defined in claim 15 in which said step of opposing said die moving force urging automatically relieving pressure against said fluid above a predetermined amount during said fluid flow; and in which said method includes the further step of automatically replenishing said fluid to a predetermined amount after said step of opposing said die moving force urging.

20. In a method of bulging hollow bulbous metal knobshells as defined in claim 15 in which said method includes the further steps of after said forming of said knobshell outwardly against said die cavity surfaces, separating said dies, ejecting said knobshell from said dies, and during knobshell ejection, positively interrupting fluid flow internally of said knobshell.

21. In a method of bulging hollow bulbous metal knobshells as defined in claim 15 in which said step of opposing said die moving force urging includes urging said dies against a piston within a cylinder to force flow of fluid within said cylinder internally of said knobshell through said knobshell neck access opening, and during said forcing of said fluid flow, automatically relieving pressure against said fluid by said piston above a predetermined maximum amount to limit said fluid pressure to said maximum amount.

22. In a method of bulging hollow bulbous metal knobshells as defined in claim 15 in which said step of opposing said die moving force urging includes moving said dies against a piston within a cylinder to force flow of fluid within said cylinder internally of said knobshell through said knobshell neck access opening, and during said forcing of said fluid flow, automatically relieving pressure against said fluid by said piston above a predetermined maximum amount to limit said fluid pressure to said maximum amount; and in which said method includes the further step of automatically replenishing supply of said fluid to a predetermined total amount after said step of opposing said die moving force urging has been completed.

23. In a method of bulging hollow bulbous metal knobshells as defined in claim 15 in which said step of opposing said die moving force urging includes moving said dies against a piston within a cylinder to force flow of fluid within said cylinder internally of said knobshell through said knobshell neck access opening; and in which said method includes the further steps of after said forming of said knobshell outwardly against said die cavity surfaces, separating said dies, ejecting said knobshell from said dies, and during knobshell ejection, positively interrupting fluid flow internally of said knobshell.

24. In a method of bulging hollow bulbous metal knobshells as defined in claim 15 in which said step of opposing said die moving force urging includes moving said dies against a piston within a cylinder to force flow of fluid within said cylinder internally of said knobshell through said knobshell neck access opening, and during said forcing of said fluid flow, automatically relieving pressure against said fluid by said piston above a predetermined maximum amount to limit said fluid pressure to said maximum amount; and in which said method includes the further steps of after said forming of said knobshell outwardly against said die cavity surfaces, separating said dies, ejecting said knobshell from said dies, and during knobshell ejection, positively interrupting fluid flow internally of said knobshell.

25. In a method of bulging hollow bulbous metal knobshells as defined in claim 15 in which said method includes the further step of during said step of opposing said die moving force urging, maintaining maximum pressure of said fluid a maximum amount by automatically relieving said pressure above said maximum; and in which said method includes the further steps of after said forming of said knobshell outwardly against said die cavity surfaces, separating said dies, ejecting said knobshell from said dies, and during knobshell ejection, positively interrupting fluid flow internally of said knobshell.

* * * * *